US005711350A

United States Patent [19]

Eisinger

[11] Patent Number: 5,711,350

[45] Date of Patent: Jan. 27, 1998

[54] PIPING SYSTEMS PROVIDING MINIMAL ACOUSTICALLY-INDUCED STRUCTURAL VIBRATIONS AND FATIGUE

[75] Inventor: Frantisek L. Eisinger, Demarest, N.J.

[73] Assignee: Foster Wheeler Energy International Inc., Clinton, N.J.

[21] Appl. No.: 690,043

[22] Filed: Jul. 31, 1996

Related U.S. Application Data

[63] Continuation-in-part of Ser. No. 526,613, Sep. 11, 1995, abandoned.

[51] Int. Cl.[6] ..... F15D 55/00

[52] U.S. Cl. ..... 138/45; 138/40; 251/118

[58] Field of Search ..... 138/44, 40, 37, 138/45; 251/118, 127

[56] References Cited

U.S. PATENT DOCUMENTS

| | | | |
|---|---|---|---|
| 797,027 | 8/1905 | Tilden | 138/44 X |
| 3,877,895 | 4/1975 | Wonderland et al. | 138/44 X |
| 4,422,339 | 12/1983 | Gall et al. | 138/44 X |
| 5,085,058 | 2/1992 | Aaron et al. | 138/44 X |
| 5,315,859 | 5/1994 | Schommer | 138/44 X |

OTHER PUBLICATIONS

Technical Paper 82–WA/PVP–8; American Society of Mechanical Engineers; Acoustically Induced Piping Vibration in High Capacity Pressure Reducing Systems; V.A. Caruccii et al.

Technical Paper by F.L. Eisinger—Designing Piping Systems Against Accoustically–Induced Structural Failure PVP–vol. 328, Flow–Induced Vibration ASME 1996 p. 397 etc.

*Primary Examiner*—Patrick F. Brinson

*Attorney, Agent, or Firm*—Martin Smolowitz

[57] ABSTRACT

Piping systems adapted for handling fluids such as steam and various process and hydrocarbon gases through a pressure-reducing device at high pressure and velocity conditions can produce severe acoustic vibration and metal fatigue in the system. It has been determined that such vibrations and fatigue are minimized by relating the acoustic power level (PWL) generated in the piping system to being a function of the ratio of downstream pipe inside diameter $D_2$ to its wall thickness $t_2$. Additionally, such vibration and metal fatigue can be further minimized by relating the fluid pressure drop $\Delta p$ and downstream Mach number $M_2$ to being a function of the ratio of downstream piping inside diameter $D_2$ to the pipe wall thickness $t_2$, as expressed by $M_2\Delta p=f(D_2/t_2)$. Pressure-reducing piping systems designed according to these criteria exhibit minimal vibrations and metal fatigue failures and have long operating life.

10 Claims, 5 Drawing Sheets

● ACOUSTICALLY INDUCED FAILURES
⊙ FAILURE AT SEVERELY UNDERCUT WELD
○ NO FAILURES

PIPING SYSTEMS PROVIDING MINIMAL ACOUSTICALLY-INDUCED STRUCTURAL VIBRATIONS AND FATIGUE

The present invention is a Continuation-In-Part of application Ser. No. 08/526,613 filed Sep. 11, 1995 now abandoned.

BACKGROUND OF INVENTION

This invention pertains to piping systems which have pressure-reducing stations and are subjected to acoustically-induced vibrations. It pertains particularly to such piping systems arranged for providing minimal acoustically-induced high frequency vibrations and resulting metal fatigue for the system.

Piping systems having high capacity pressure-reducing stations, such as safety valve let-down systems or compressor recycle systems and the like, are typically exposed to large internal acoustic loadings which cause piping vibrations and vibratory stresses in the piping system. If the piping system is not properly designed and constructed so as to minimize the effect of such acoustic excitation phenomenon, excessive vibration and consequently undesired fatigue failures of the piping system can result. In extreme cases, such piping system failures can occur in a matter of days or even hours.

Structural vibrations of piping systems have usually been treated as a low frequency (20–200 Hz) phenomenon associated primarily with pipe beam bending modes and pipe ovalizing modes. High frequency (1,000–20,000 Hz) vibrations caused by internal acoustic waves has been recognized only recently as being responsible for structural fatigue problems in piping systems. The present known method of designing piping systems having pressure-reducing stations such as that generally shown in FIG. 1, against such acoustically induced vibration and metal fatigue is based on a publication by V. Carucci and R. Mueller, entitled "Acoustically Induced Piping-Vibration In High Capacity Pressure Reducing Systems" ASME-82-wP/PVP-8, 1982. Based on in-service experience with 36 cases of acoustically loaded piping systems (9 with failures and 27 with no failures), the authors developed a general relationship between acoustic power input to a piping system and pipe inside diameter as a basis for design of piping systems. The acoustic power level (PWL) occurring immediately downstream from the pressure-reducing device used by Carucci and Mueller is given by the expression:

$$PWL = 10\log\left(\left(\frac{\Delta p}{p1}\right)^{3.6} W^2 \left(\frac{T_1}{m}\right)^{1.2}\right) + 126.1$$

where PwL is the acoustic power level in decibles dB (with reference power of $10^{-12}$ watts). See Table 1 below for the units of flow parameters.

FIG. 2 shows the Carucci and Mueller data plotted on the basis of acoustic power level (PWL) given by the above equation versus the downstream pipe inside diameter $D_2$. A recommended fatigue design limit line enveloping the no failures piping cases is also shown. Piping system cases located above the design limit line shown would be in the expected piping system failure region, and cases below the design limit line would be predicted to have no vibration and fatigue failures. It can be seen that the recommended design limit is not perfect and reliable, because three no failure cases are present in the region of the piping system fatigue failures.

This Carucci and Mueller method is presently being used in design of piping systems because no other method is available for such design at the present time. Accordingly, although some procedures and parameters for the design and construction of such acoustically loaded piping systems against acoustic vibration and metal fatigue failures are known and have been used, improved piping system designs and constructions which are economic and more reliable have been sought.

SUMMARY OF INVENTION

This invention provides a piping system including a pressure-reducing device or means specially adapted for handling fluids at high pressure and high velocity conditions, and for which acoustically-induced high frequency vibrations and resulting metal fatigue may occur. For such a piping system constructed and operated according to this invention, high frequency acoustically-induced vibrations and resulting metal fatigue are reduced below an acceptable level or magnitude, thereby assuring safe and long operating life for the piping system.

It has been determined that for piping systems having a pressure-reducing means such as an orifice or valve, an improved relationship between the acoustic power level (PWL) generated in the piping section downstream from the pressure-reducing means and a downstream pipe parameter is expressed by the acoustic power level (PWL) being a function of the ratio between the downstream pipe diameter and its wall thickness, and not a function of the downstream pipe diameter alone. This relationship is expressed by the following equation:

$$PWL = 176.6 - 0.125 D_2/t_2$$

for which $D_2$=inner diameter of downstream piping, $t_2$=wall thickness of downstream piping This improved relationship for analysis of piping systems is shown graphically by FIG. 3.

It has been found that acoustically-loaded piping systems designed and constructed according to this improved criteria provide improved reliability and further safety compared to presently known design procedures and criteria described by Carucci and Mueller, as shown by FIG. 2.

It has been further determined that a stronger and even more predictable relationship for determining piping system vibration and metal fatigue boundary conditions for systems subjected to acoustically-induced high frequency vibration and metal fatigue is provided by a relationship between the flowing fluid differential pressure and downstream fluid Mach number being a function of the downstream pipe diameter and its wall thickness, expressed as follows:

$$M_2\Delta p = \text{Function of } (D_2/t_2)$$

where:

$M_2$=downstream Mach number for flowing fluid $\Delta p$=pressure drop across restriction in piping system $D_2$=inner diameter of downstream pipe $t_2$=wall thickness of downstream pipe This further improved relationship for analysis of piping systems is shown graphically by FIG. 4.

Acoustically-loaded piping systems designed and operated according to this second improved or alternative relationship per FIG. 4 provide further increased reliability and safety for the system.

This invention advantageously discloses important relationships between acoustic power generated in a piping system and basic structural parameters of the improved system as shown schematically by FIG. 5. The invention also provides piping systems for handling fluids at high pressure and velocity conditions which produce minimal acoustically-induced structural vibration and metal fatigue, and which assure greater reliability and safety in the operation of such piping systems.

BRIEF DESCRIPTION OF DRAWINGS

This invention will be further described with reference to the following drawings, in which.

DESCRIPTION OF INVENTION

Figure 1:
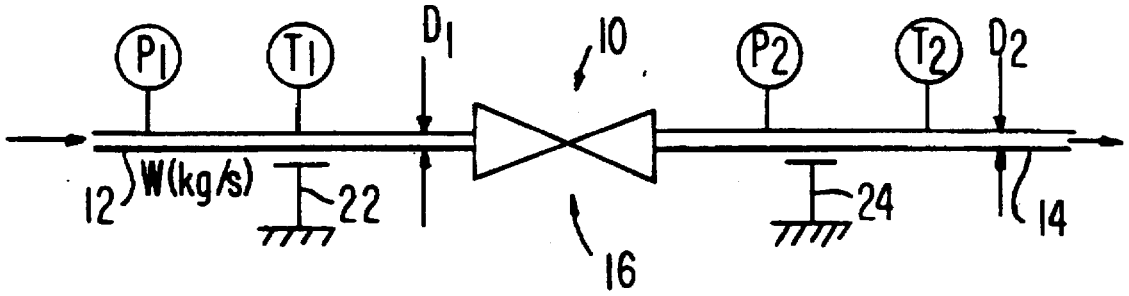
FIG. 1 PRIOR ART
FIG. 1 is a schematic drawing of a known basic piping system including an upstream portion and a downstream portion separated by a pressure-reducing device.

FIG. 1 shows schematically a basic piping system 10 containing an upstream section 12 and a downstream section 14 separated by a pressure-reducing device 16 such as a valve, an orifice plate, or the like. The upstream piping section 12 is supported by a suitable support means 22, and the downstream piping section 14 is supported by suitable support means 24. When such a piping system 10 is operated at high downstream velocity conditions, acoustically induced vibrations of the pipe wall occur in both axial and circumferential flexural modes. The principal fluid flow and structural parameters which exist in the system upstream and downstream of the pressure reducing device 16 are given in Table 1.

TABLE 1

| Piping System Fluid Flow Parameters | |
|---|---|
| $p_1p_2$ = | upstream and downstream pressure, Pa |
| $\Delta p = p_1 - p_2$ = | pressure drop across valve, Pa |
| $T_1T_2$ = | upstream and downstream temperature, °K. |
| W = | flow rate of gas and liquid, kg/s |
| $D_1D_2$ = | pipe inside diameters upstream and downstream, m |
| k = | $c_p/c_v$ ratio of specific heats of flowing fluid |
| m = | molecular weight of flowing fluid |
| $t_1T_2$ = | piping thickness upstream and downstream, m |
| $M_2$ = | Mach number of downstream flowing fluid |

Figure 2:
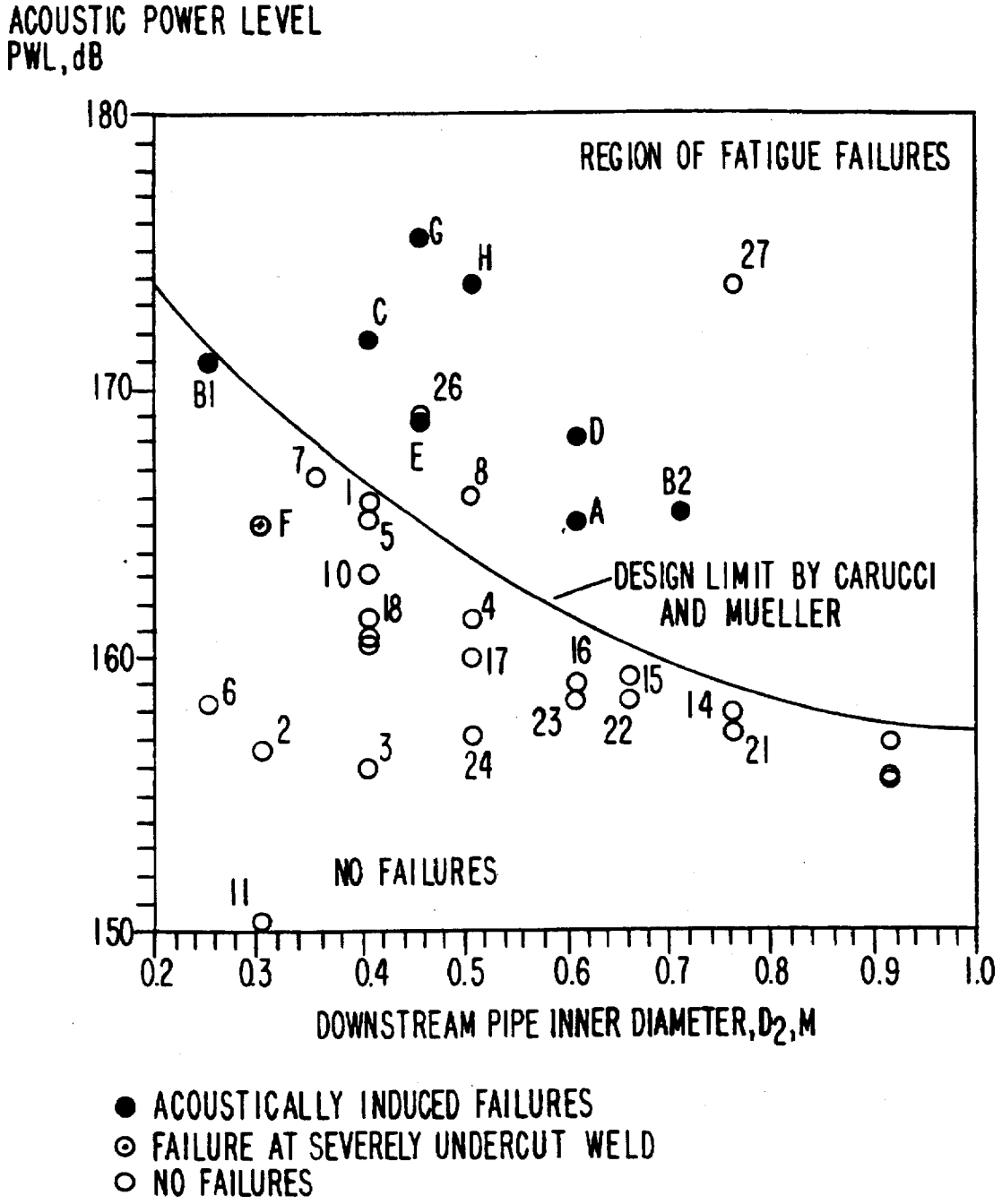
FIG. 2 PRIOR ART
FIG. 2 is a graph showing a known relationship between acoustic power loading (PWL) and downstream pipe inner diameter for a piping system.
Figure 3:
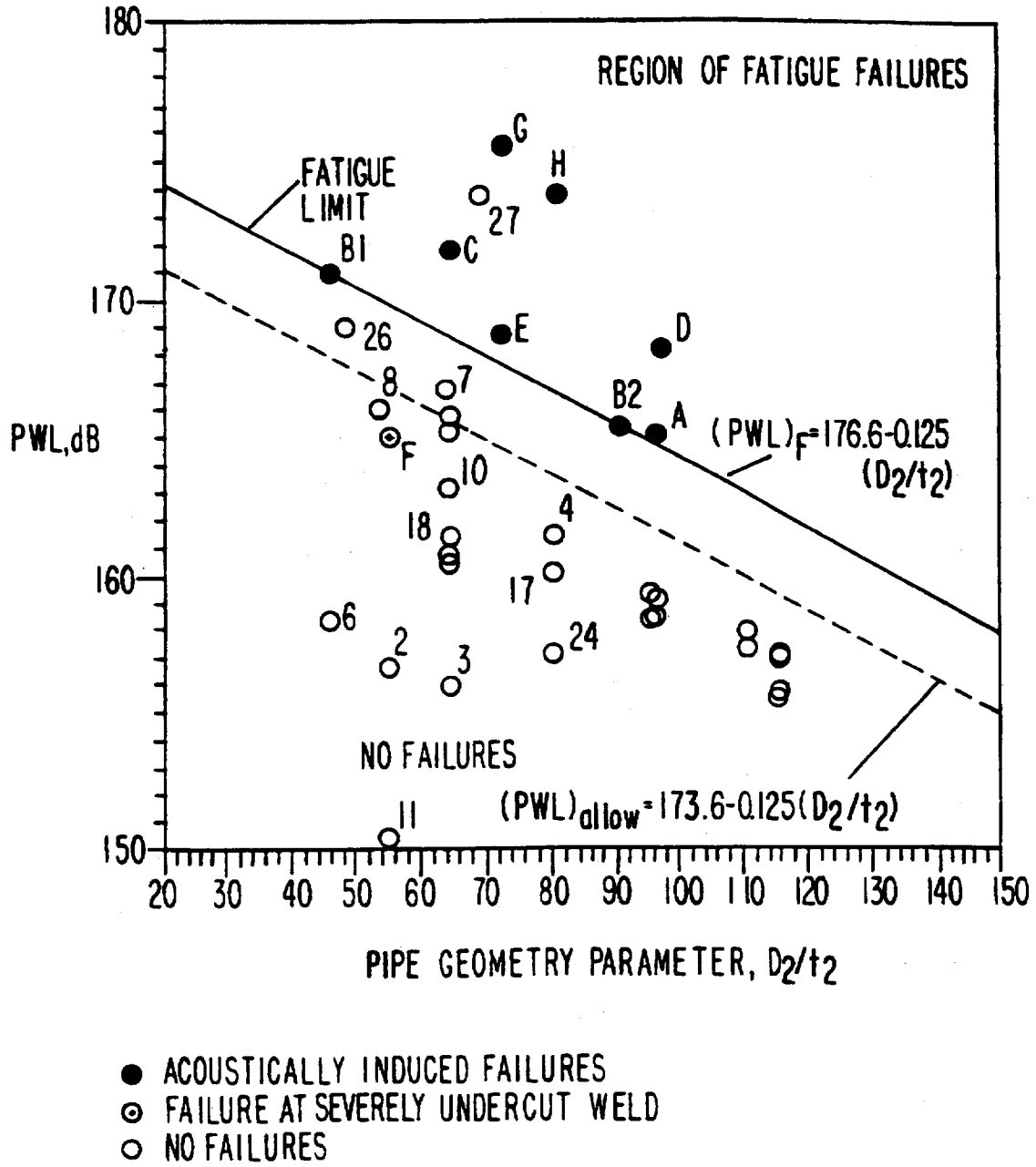
FIG. 3 is a modified graph showing an improved relationship between acoustic power level loading (PWL) for a piping system and its downstream geometry parameter $D_2/t_2$.
Figure 5:
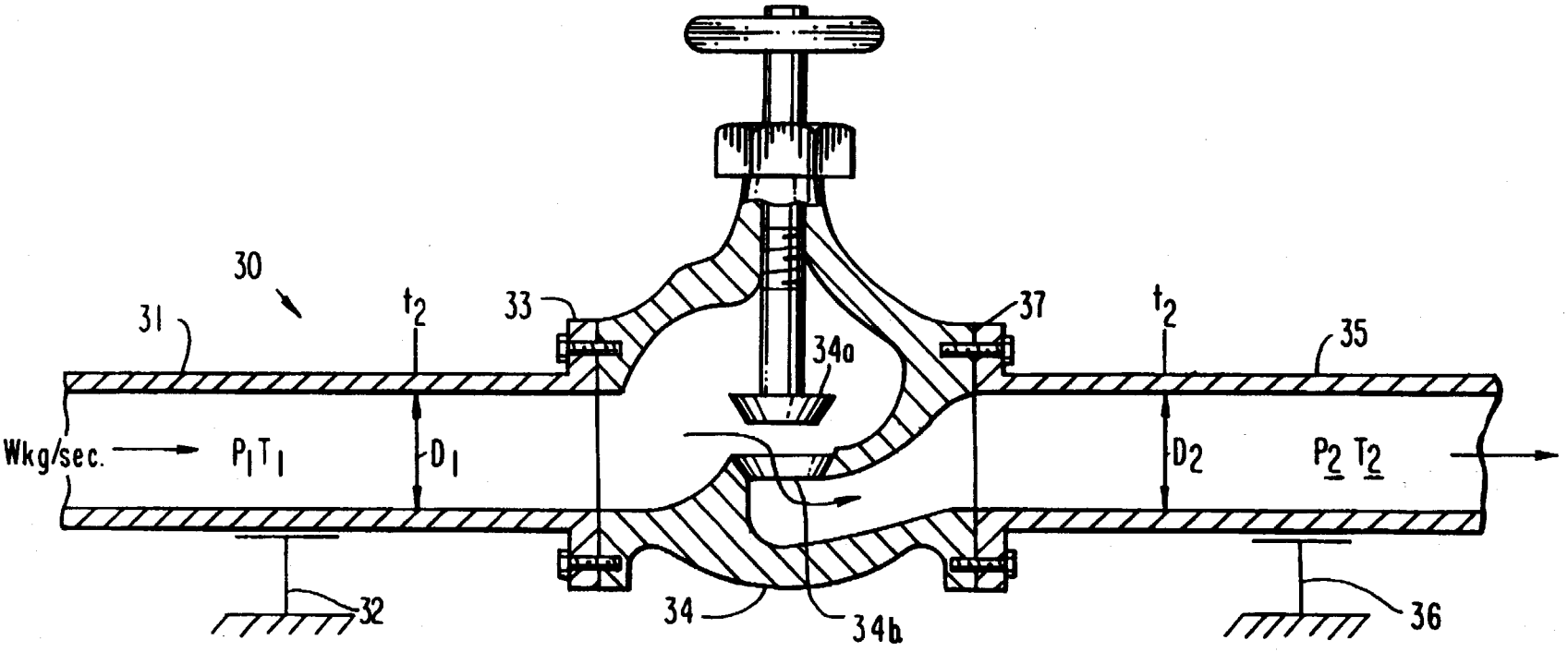
FIG. 5 is a schematic drawing of an improved piping system including an upstream section and a downstream section separated by a pressure-reducing valve means, all constructed and operated according to the present invention.

According to this invention, the known Carucci and Mueller design guideline for piping systems as shown by FIG. 2 has been improved by relating the acoustic power level PWL for a piping system to the downstream pipe geometry parameter $D_2/t_2$, instead of relating it to downstream diameter $D_2$ alone, as was done by the Carucci and Mueller method. This improved piping system is shown by FIG. 5, in which the piping system 30 includes an upstream pipe section 31 suitably supported at 32 and having flange 33 connected pressure-tightly to a pressure-reducing valve 34. The upstream pipe section 31 has internal diameter $D_1$ and wall thickness $t_1$. The valve 34 contains a vertically-movable plug **34*a* which can be seated onto a seating surface 34*b* having a flow diameter and area less than that of the upstream pipe section 31. Downstream pipe section 35 is suitably supported at 36 and has flange 37 connected pressure-tightly to the valve 34. The downstream pipe section 35 has internal diameter $D_2$ and wall thickness $t_2$. The piping system 30 carries a fluid flow rate of W expressed as kg/sec, which flow has sufficient high velocity to produce acoustically-induced high frequency vibrations and metal fatigue in the downstream pipe section 35**. This improved piping system has a design parameter, which reflects the ratio of the downstream piping suction acoustical and dominant flexural structural natural vibration frequencies and better represents the physical phenomena of coincidences of acoustical and structural frequencies which are the underlying cause of the pipe failures. FIG. 3 shows the piping system data of Carucci and Mueller replotted in a graph of PWL vs $D_2/t_2$. It is seen that a straight line fatigue failure limit boundary separates the two suitable and unsuitable system regions quite well.

This fatigue limit boundary line shown in FIG. 3 can be expressed by the equation:

$$(PWL)_F = 176.6 - 0.125\ (D_2/t_2)$$

where $(PWL)_F$ is the acoustic power level causing vibration and fatigue failures and $D_2/t_2$ is the downstream pipe section geometry parameter. Using a safety factor of 2 based on allowable metal stress values consistent with ASME design procedures, one would obtain an allowable fatigue limit given by $$(PWL)_{allowable} = 173.6 - 0.125\ (D_2/t_2)$$

where $(PWL)_{allowable}$ is the design allowable acoustic power level for a particular piping section geometry. The $D_2/t_2$ ratio is related to the stiffness and also natural vibration frequency of the pipe wall, reflecting both the ovalization and out-of-plane wave-like vibratory motion of the pipe wall.

Although the downstream piping ratio $D_2/t_2$ has some effect on the unsupported length and the axial or beam-bending stiffness of the piping as shown by FIG. 5, it does not govern the piping vibratory behavior in this bending mode. The spacing of the pipe structural supports 32 and 36 does govern this behavior, but this is a separate consideration. The described method of properly designing and constructing piping system against structural vibration and fatigue failures considers vibrations at high frequencies, generally in the range of 1,000–20,000 cycles per second. The external piping support system determines the piping vibratory characteristics in the low frequency range, say 10–200 Hz, depending on the pipe size and spacing of supports. The type and number of external piping supports 32 and 36 have only a minor (if any) effect on the acoustically-induced fatigue caused by internal high frequency acoustic loading for a piping system.

Although the external supports for a piping system will have a small effect, it is very important to provide a piping design with a minimum number of attachments, welded connections, rapid changes in diameter, sudden changes in wall thickness, etc. The attachments (welded connections) should be placed symmetrically around the circumference of the pipe, smooth transitions and full penetration welds should be used. Surface smoothness and symmetry are necessary features to minimize vibratory stresses from internal acoustic loading.

Further according to this invention, it has been determined that the acoustic energy driving the acoustic waves downstream of a pressure-reducing means 34, such as an orifice plate or valve, in a piping system 30 can be measured more accurately and reliably by the acoustic input energy parameter $M_2\Delta p$, where $M_2$ is the downstream fluid Mach number and $\Delta p$ is the pressure drop across the flow restriction or valve. This input energy approach has been used very successfully in predicting resonant acoustic vibration and metal fatigue in tube bundles.

Figure 4:
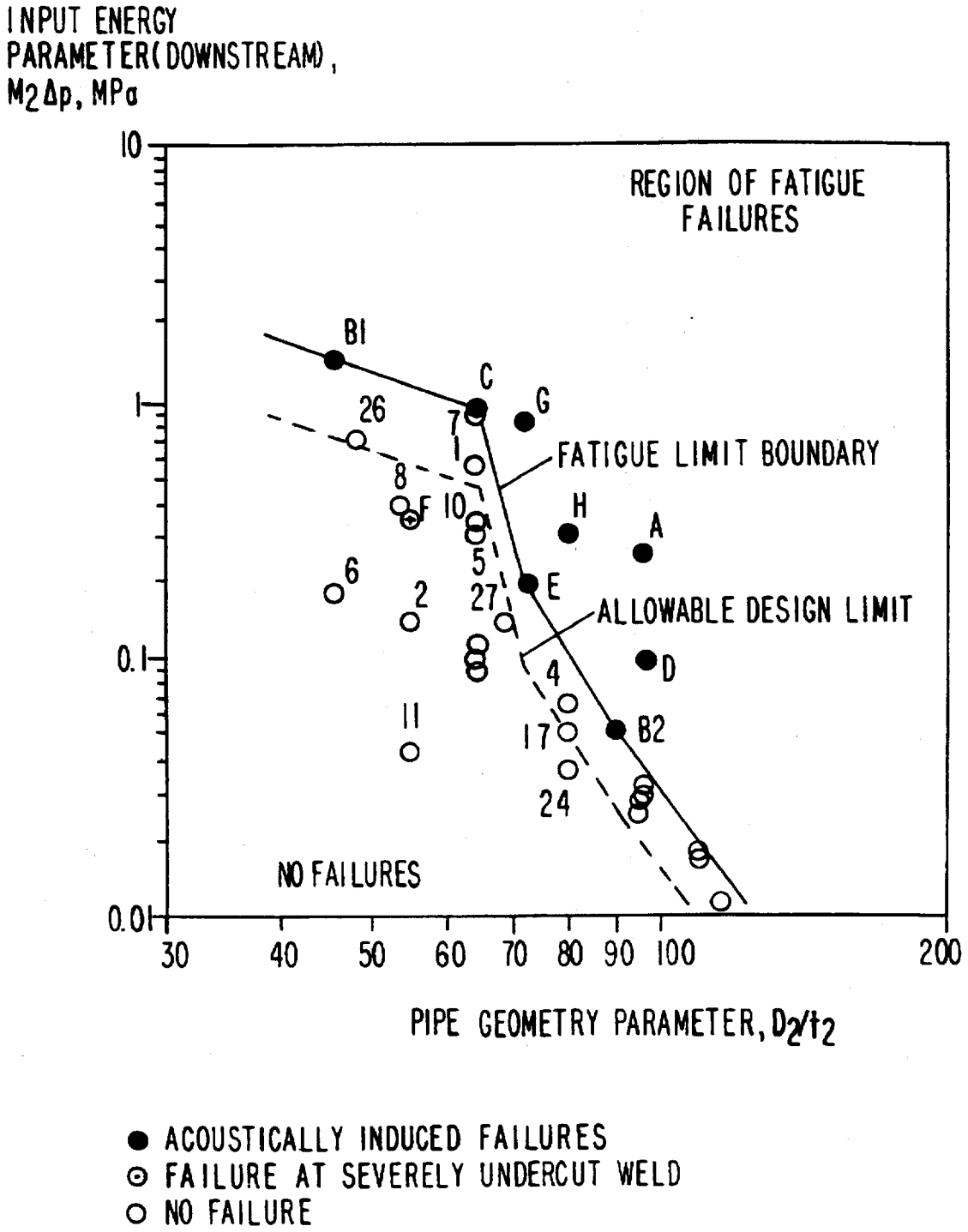
FIG. 4 is a graph showing a further improved relationship for input acoustic energy parameter $M_2\Delta p$ for a piping system related to its downstream pipe geometry parameter $D_2/t_2$.

FIG. 4 shows all the Carucci and Mueller system data from FIG. 2 plotted on the basis of the input acoustic energy parameter $M_2\Delta p$ versus a function of $D_2/t_2$. A fatigue boundary limit defined by specific data points B1, C, E and B2 is shown to exist, which separates all the failure cases from those with no failures (except for data point F which had a severely undercut weld and consistently shows up in the no-failure region). As can be seen, the vibration and fatigue limit boundary is not a smooth line, but includes a "hump" enveloping the no failure piping system cases. The rapid decrease in the input energy parameter $M_2\Delta p$ which is needed to cause piping system fatigue failures in the range of $D_2/t_2$ greater than about 65 appears to be consistent with a significant increase of the number of acoustic and structural frequency coincidences (or resonances) in the region. At larger pipe diameters above $D_2/t_2$ of 65, the number of such coincidences increases exponentially and with it the likelihood of pipe system failures due to acoustic vibrations also increases significantly.

Based on the fatigue limit boundary $(M_2\Delta p)_F$, an allowable fatigue boundary $(H_2\Delta p)_{allowable}$ can be obtained by again using a safety factor of 2, as follows:

$$(M_2\Delta p)_{allowable}=\tfrac{1}{2}(M_2\Delta p)_F$$

which then can be used directly for piping system design purposes.

From FIG. 3 it can be seen that the limit acoustic power level (PWL) is not a strong function of $D_2/t_2$. However, this is in contrast with the improved relationship shogun in FIG. 4, where the limiting acoustic input energy parameter $(M_2\Delta p)_F$ is a strong function of $D_2/t_2$. This steep relationship of $(M_2\Delta p)_F$ vs $D_2/t_2$ appears to be much more consistent with the physical nature of the acoustically-induced resonant pipe vibration process.

The cases of piping system fatigue failures reported for the known Carucci and Mueller method were evaluated using (a) the improved method based on acoustic power levels per FIG. 3, and (b) the new input energy method per FIG. 4. The comparison results are given below in Table 2.

TABLE 2

Comparison of Piping System Design Methods Based on Acoustic Power Level (FIG. 3) and Acoustic Input Energy (FIG. 4)

| | | Acoustic Power Level Method (FIG. 3) | | Acoustic Input Energy Method (FIG. 4) | |
|---|---|---|---|---|---|
| Case | Original $D_2/t_2$ Required | New $D_2/t_2$ Required | Required Increase in Wall Thickness $t_2$ % | New $D_2/t_2$ Required | Required Increase in Wall Thickness $t_2$ % |
| A | 96 | 68 | 41 | 68 | 41 |
| B1 | 45.6 | 20 | 128 | 25 | 82 |
| B2 | 89.7 | 66 | 36 | 82 | 9 |
| C | 64 | No Solution | — | 39 | 64 |
| D | 96 | 43 | 123 | 72 | 33 |
| E | 72 | 40 | 67 | 69 | 4.5 |
| G | 72 | No Solution | — | 42 | 71 |
| H | 80 | No Solution | — | 65 | 23 |

It can be seen that the first improved design method based on acoustic power level method per FIG. 3, although improved relative to the original Carucci and Mueller FIG. 2 method, is inferior to the second improved design method based on the acoustic input energy parameter $M_2\Delta p$ per FIG. 4. All the piping design cases evaluated have a simple solution when the design is based on the input energy method per FIG. 4. The solution is straight forward and the choice may be in increasing the wall thickness of the pipe downstream of the pressure reducing device. As can be seen, wall thickness increases in the range of 4.5% to 82% would be necessary for a correct design based on the acoustic input energy method.

In contrast, the acoustic power level method per FIG. 3 would not lead to a solution in three out of the listed eight cases, while in the remaining cases a very substantial increase in wall thickness would be needed. The original acoustic power level method of Carucci and Mueller, which does not include the wall thickness $t_2$ does not offer any direct solutions, except for directing a piping system designer to either change the pressure reducing devices (valves) to specially designed multi-stage devices, or substantially re-design the piping system into a multi-parallel pass system with reduced flows and pressure drops, an expensive and undesired alternative. It thus can be seen that the new design method and piping system based on acoustic input energy $M_2\Delta p=f\ (D_2/t_2)$ offers direct and economical design solutions.

This invention is useful for improved piping systems as shown by FIG. 5, which are operated at pressures of 10–5000 psia (0.07–34.5 MPa) and 65°–1000° F. (18°–540° C.) temperature, for which fluid flow velocities downstream from a flow restriction are in the range of 5–5,000 ft/sec (1.5–1,500 m/s). The invention is also useful for downstream pipe inside diameters $D_2$ of 4–48 inch (0.10–1.2 m) and for wall thickness $t_2$ of 0.25–3.0 inch (0.006–0.076 m) downstream from a flow restriction, with $D_2/t_2$ ratio being in the range of 16–160 and preferably 25 to 125. Such piping systems are suitably constructed using alloy steel materials.

Although this invention has been described broadly and in terms of preferred embodiments, it is understood that modifications and variations can be made within the scope as defined by the following claims.

I claim:

1. A piping system adapted for handling flowing fluids under high pressure and flow velocity conditions, with minimal acoustically-induced vibrations, said system comprising:

(a) an elongated upstream pipe section having inner diameter $D_1$ and wall thickness $t_1$;

(b) a pressure-reducing device connected pressure-tightly to the upstream pipe section outlet end, said device including an orifice having diameter less than the inner diameter of said upstream pipe section; and (c) an elongated downstream pipe section connected pressure-tightly to said pressure-reducing device and having inner diameter $D_2$, and wall thickness $t_2$; whereby the piping system has an operational acoustic power level PWL which for said downstream pipe section during fluid flowing operation does not exceed that determined by the relationship PWL allowable= 173.6–0.125 $D_2/t_2$ so as to minimize acoustically-induced structural vibrations in the piping system.

2. The piping system according to claim 1, wherein said pressure-reducing device provides a fluid pressure drop $\Delta p$ and the flowing fluid in said downstream pipe section has a Mach number $M_2$, and the operation acoustic power level PWL does not exceed that defined by the relationship $M_2\Delta p$=Function $D_2/t_2$.

3. The piping system according to claim 1, wherein said downstream pipe section has an inside diameter $D_2$ between about 4 and 48 inch (0.10–1.2 m) and a wall thickness $t_2$ between about 0.25 and 3.0 inch (0.006–0.076 m).

4. The piping system according to claim 1, wherein said downstream pipe section geometry parameter ratio $D_2/t_2$ is within a range of 16–160.

5. The piping system according to claim 1, wherein the downstream pipe section geometry parameter ratio $D_2/t_2$ is within a range of 25–125.

6. A piping system adapted for handling flowing fluids under high pressure and flow velocity conditions, with minimal acoustically-inducted vibrations said system comprising:

(a) an elongated upstream pipe section having inner diameter $D_1$ and wall thickness $t_1$;

(b) a pressure-reducing device connected pressure-tightly to the upstream pipe section outlet end, said device including an orifice having diameter less than the inner diameter of said upstream pipe section; wherein said pressure-reducing device provides a fluid pressure drop $\Delta p$; and (c) an elongated downstream pip section connected pressure-tightly to said pressure-reducing device and having inner diameter $D_2$ and wall thickness $t_2$ the flowing fluid in said downstream pipe section having a Math number $M_2$; whereby the piping system has an operational acoustic power level which for said downstream pipe section during fluid flowing operation does not exceed that defined by the relationship $M_2\Delta p$= Function of $D_2/t_2$, and the downstream pipe section geometry parameter ratio $D_2/t_2$ is within a range of 16–160, so as to minimize acoustically-induced structural vibrations and metal fatigue in the piping system.

7. The piping system according to claim 6, wherein said downstream pipe section has an inside diameter $D_2$ between about 4 and 48 inch (0.10–1.2 m) and a wall thickness $t_2$ between about 0.25 and 3.0 inch (0.006–0.76 m).

8. The piping system according to claim 1, wherein said pressure-reducing device is a valve.

9. The piping system according to claim 2, wherein the downstream pipe ratio of $D_2/t_2$ is in a range of about 65–100.

10. The piping system according to claim 6, wherein the downstream pipe section geometry parameter ratio $D_2/t_2$ is in a range of about 65–100.

* * * * *